United States Patent [19]

Graham

[11] 4,050,348

[45] Sept. 27, 1977

[54] LIQUID PROPELLANT GUN (CONTROLLED LEAKAGE REGENERATIVE PISTON)

[75] Inventor: Alfred Rapp Graham, Burnt Hills, N.Y.

[73] Assignee: General Electric Company, Burlington, Vt.

[21] Appl. No.: 694,866

[22] Filed: June 10, 1976

[51] Int. Cl.[2] ..... F41F 1/04

[52] U.S. Cl. ..... 89/7; 89/1 K

[58] Field of Search ..... 89/7, 9, 1 K; 417/349, 417/377, 381; 60/39.01

[56] References Cited

U.S. PATENT DOCUMENTS

| | | | |
|---|---|---|---|
| 2,922,341 | 1/1960 | Treat | 89/7 |
| 2,981,153 | 4/1961 | Wilson et al. | 89/7 |
| 2,986,072 | 5/1961 | Hudson | 89/7 |
| 3,138,990 | 6/1964 | Jukes et al. | 89/7 |
| 3,763,739 | 10/1973 | Tassie | 89/7 |

*Primary Examiner*—David H. Brown
*Attorney, Agent, or Firm*—Bailin L. Kuch

[57] ABSTRACT

A liquid propellant gun utilizes a differential piston having a plurality of bores through its head, which head divides the liquid propellant pumping chamber from the combustion chamber, and propellant supply means providing liquid propellant under pressure into said pumping chamber, which propellant under pressure both advances the piston to enlarge the pumping chamber and to decrease the combustion chamber and injects and atomizes a predetermined quantity of propellant through said bores from said pumping chamber into said combustion chamber.

6 Claims, 5 Drawing Figures

LIQUID PROPELLANT GUN (CONTROLLED LEAKAGE REGENERATIVE PISTON)

BACKGROUND OF THE INVENTION

1. Field of the Invention

This invention relates to liquid propellant guns utilizing a differential piston to provide continued or regenerative injection of propellant into the combustion chamber after initial ignition of propellant in the chamber.

2. Prior Art

Liquid propellant guns utilizing differential pistons to pump propellant into the combustion chamber during combustion are now well know. Early work is described in a Final Report of Nov. 19, 1953—Jan. 31, 1956 under contract DA-36-034-ORD-1504RD, Project TS1-47-8 by V. M. Barnes, Jr. et al which apparently in part corresponds to Jukes et al., U.S. Pat. No. 3,138,990 filed Oct. 9, 1961; in a report No. 17-2 of June 15, 1954 under contract NOrd-10448 by C. R. Foster el at; and in a Final Report of Sept. 1, 1957 under contract NOrd 16217, Task 1, by L. C. Elmore et al. Other patents of interest are J. W. Treat, Jr., U.S. Pat. No. 2,922,341, filed Nov. 7, 1955; E. J. Wilson, Jr. et al., U.S. Pat. No. 2,981,153, filed Nov. 14, 1952; C. M. Hudson, U.S. Pat. No. 2,986,072, filed Nov. 19, 1952; and E. J. Vass, et al., U.S. Pat. No. 3,690,255 filed Oct. 1, 1970.

An object of this invention is to provide an improved liquid propellant gun having a combustor assembly utilizing a differential piston wherein a uniform metered quantity of atomized propellant may be passed into the combustion chamber to serve as a primer without additional valves in said piston.

A second object of the invention is to avoid the complexity of providing a means for retaining propellant behind the piston during the filling operation by simply allowing said propellant to "leak" through the piston into the combustion chamber for purposes described under the first object of the invention.

A feature of this invention is the provision of a liquid propellant gun utilizing a differential piston having a plurality of bores through its head, which head divides the liquid propellant pumping chamber from the combustion chamber, and propellant supply means providing liquid propellant under fixed feed pressure into said pumping chamber, which propellant under pressure both advances the piston to enlarge the pumping chamber and to decrease the combustion chamber while increasing pressure in said combustion chamber and injects and atomizes a predetermined quantity of propellant through said bores from said pumping chamber into said combustion chamber to serve as a primer.

RELATED CASE

Subject matter directed to the details of the check valve disclosed herein is claimed in the Application of D. P. Tassie, Ser. No. 694,867 filed concurrently herewith, on June 10, 1976.

BRIEF DESCRIPTION OF THE DRAWING

These and other objects, advantages and features of the invention will be apparent from the following specification thereof taken in conjunction with the accompanying drawing in which.

DESCRIPTION OF THE PREFERRED EMBODIMENT

Figure 1:
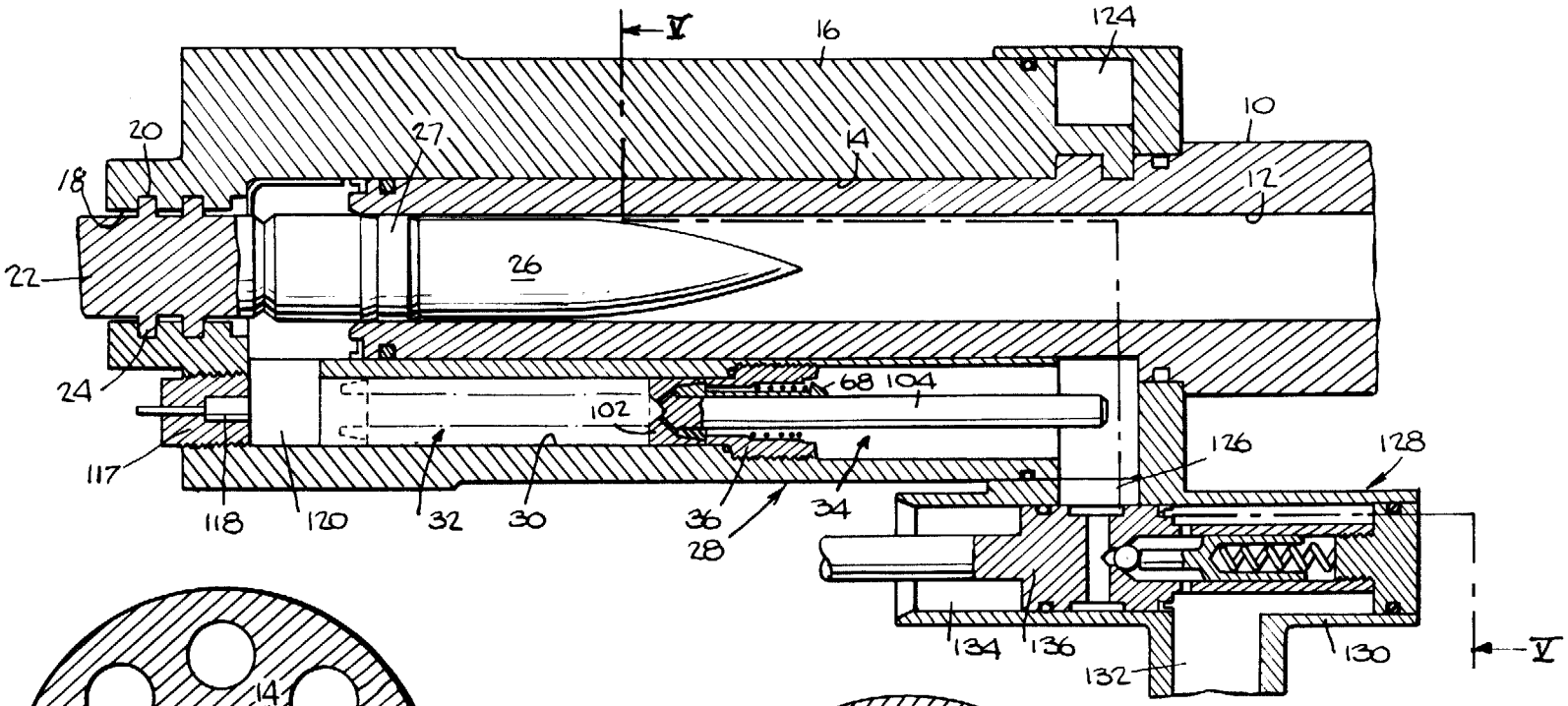
FIG. 1 is a detail view in longitudinal cross-section of a gun incorporating a combustor assembly embodying this invention.
Figure 3:
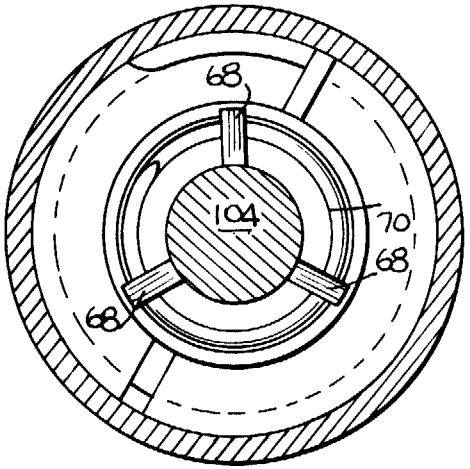
FIG. 3 is a transverse view in cross-section taken along the plane III—III of FIG. 2.

This invention, as shown in FIG. 1, may be incorporated in a liquid propellant gun of the type shown by D. P. Tassie in U.S. Pat. No. 3,763,739. However, the invention as here shown utilizes a monopropellant, although the regenerative piston system is applicable to bipropellants as well.

The gun system includes a gun barrel 10, having a gun bore 12, which is fixed in a forward bore 14 of a housing 16. The housing has an aft bore 18, with a plurality of locking recesses 20, which receives a gun bolt 22 having a plurality of locking lugs 24. A projectile 26 having a rotating band 27 may be inserted through the aft bore 18 and pushed forwardly into the gun bore 12 by the bolt 22, which bolt is then locked in and to the housing. The band 27 makes a gas tight seal with the bore.

Figure 5:
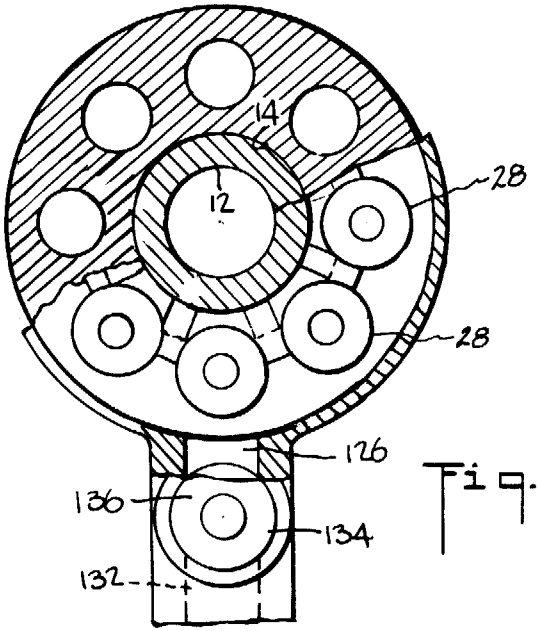
FIG. 5 is a transverse view in cross-section of a gun incorporating a plurality of the combustor assemblies of FIG. 1 taken along the folded plane V—V.
Figure 2:
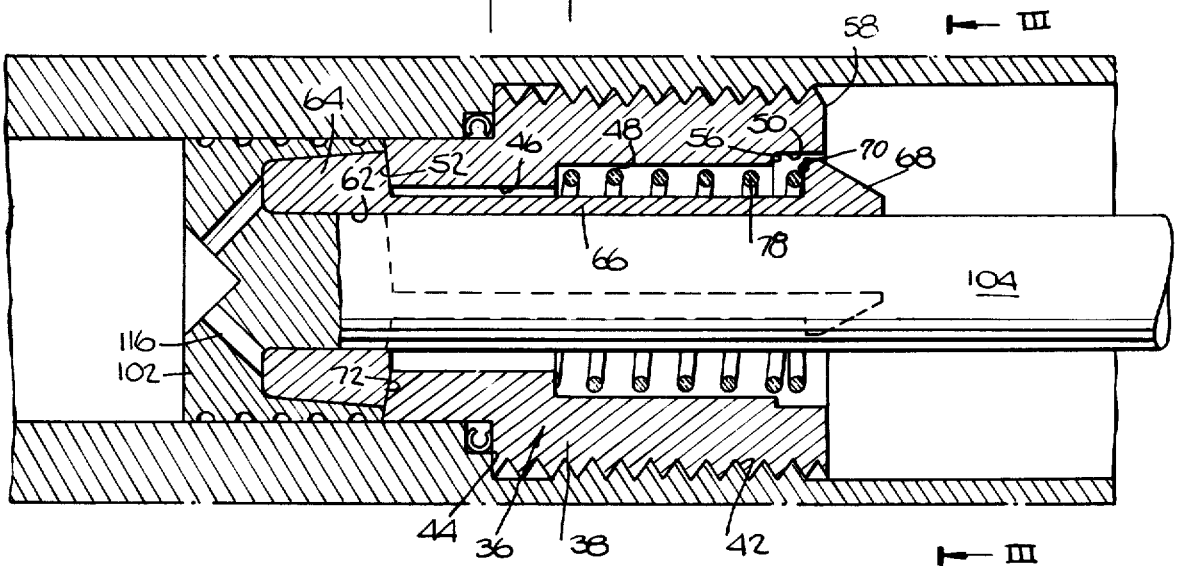
FIG. 2 is an enlarged detail of FIG. 1 of the combustor assembly in the end of propellant injection mode.
Figure 4:
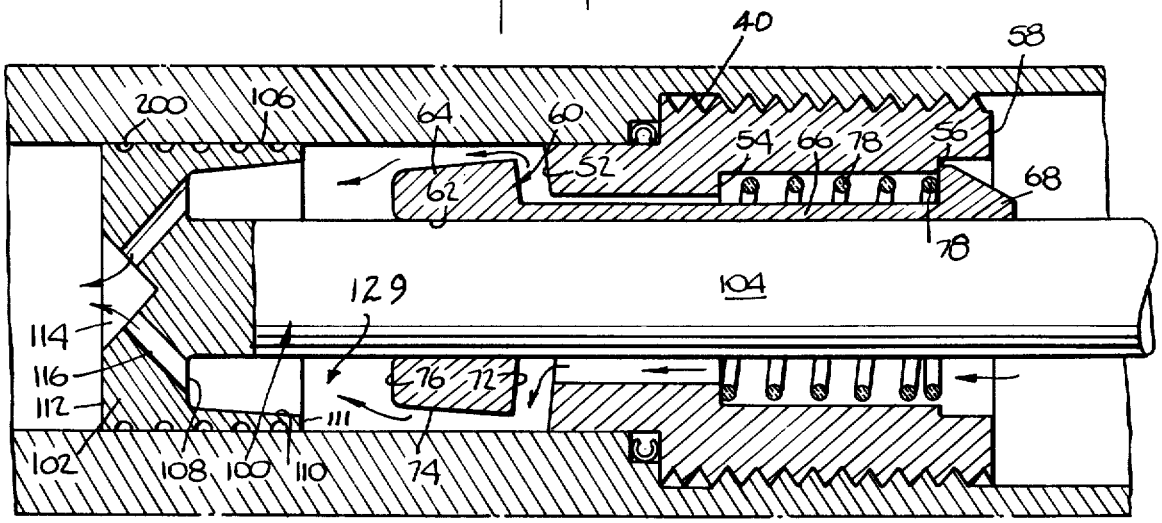
FIG. 4 is an enlarged detail of FIG. 1 of the combustor assembly in the propellant filling mode.

The housing 16 may have one, or as shown in FIG. 5, a plurality of combustor assemblies 28. As shown in FIGS. 1, 2 and 4, each combustor assembly includes a longitudinal bore 30 having a combustion chamber portion 32 and a liquid propellant inlet chamber portion 34. A coaxial check valve 36 is fixed in the bore 30 and includes an outer annular housing 38 which is externally threaded at 40 to engage threads 42 and a shoulder 44 in the bore 30, and has a longitudinal bore in three stepped portions: a portion 46 having the smallest diameter, a portion 48 having an intermediate diameter, and a portion 50 having the largest diameter. The housing 38 has a left face 52, an internal shoulder 54, an internal shoulder 56, and a right face 58. A sleeve 60 has an longitudinal bore 62, a left, truncated conical, annular portion 64, an intermediate portion provided by a plurality (here shown as three) of longitudinally extending, circumferentially spaced apart, beams 66, and a right portion provided a like plurality of heel, enlarged terminations 68 on each beam. The right portion has a left face 70 which will abut the shoulder 56, the left portion has a right face 72 which will mate with and will seal against the face 52, a conical, peripheral face 74, and a left face 76. A helical compression spring 78 is disposed between the shoulder 54 and the face 70 and biases the sleeve 60 to the right.

A piston 100 has a head portion 102 which slides in the combustion chamber portion 32 and a stem portion 104 which slides in the bore 62 of the sleeve 60. The head portion has an L-ring longitudinal cross-section with an outer-peripheral surface 106 for sliding engagement with the wall of the chamber 32, a right transverse annular surface 108 which will mate with and will seal against the face 76, a right conical annular surface 110 which will mate with and will seal against the face 74, a transverse face which will mate with and will seal against the face 52, a left face 112 having a conical recess 114, and a plurality of bores 116 disposed in an annular row and interconnecting the face 108 with the recess 114. Alternatively, these bores may be arranged as axial bores and in other configurations.

The left end of the combustion chamber 32 is closed by a plug 117 which carries a spark plug 118. A respective radial bore 120 communicates between the respective combustion chamber 32 and the left end of the bore 12.

The right end of each liquid propellant inlet chamber portion 34 opens into an annular passageway or manifold 124, which in turn is open, at 126, to a propellant supply valve 128. The valve includes a housing 130 having an inlet port 132, a cylinder 134, and a spool 136. The spool may be cam controlled, as shown in U.S. Pat. No. 3,763,739, for synchronization with the other gas functions.

As shown in FIG. 1, before loading, the valve 128 is closed and the piston 100 is in its righthandmost position wherein it is nested with and sealed to the check valve 36. A projectile 26 is inserted into the gun bore 12 and the bolt 22 is closed and locked. The spool 136 is shifted to the left, opening the valve 128, admitting liquid propellant under pressure into the manifold 124. Propellant under pressure passes into the chamber portion 34 and into the longitudinal recesses between the beams 68, and applied pressure against the surface 72 of the portion 64 to shift the portion, against the bias of the spring 78, away from the surface 52, to permit the flow of liquid propellant around the portion 64 and against thesurfaces 108 and 110 of the head 102 of the piston. This pressure provided by the incoming liquid propellant pushes the piston head to the left, creating and enlarging the available volume of a propellant pumping chamber portion 129 and decreasing the available volume of the combuston chamber portion. A small quantity of the liquid propellant passes through the bores 116 into the combustion chamber portion during this shifting of piston head, and thus a quantity of air which had entered when the bolt was open, plus this quantity of liquid propellant, are compressed and trapped in the combustion chamber. The liquid propellant is atomized as it passes through the bores, and the total quantity and the size of the droplets is a function, inter alia, of the diameter of the bores, the configuration of the bores such as axial or impinging (FIG. 4), and the pressure of the liquid propellant. When the piston head has reached its maximum excursion in compression, that is, leftmost travel, the liquid pressure in the pumping chamber portion 129 equals the liquid pressure in the supply manifold 124 and the supply chamber portion 34, and the spring 78 drives the sleeve 60 to the right, thereby closing the check valve 36. This quantity of compressed air and atomized propellant in the combustion chamber portion adjacent the sparkplug is predetermined and repeatable, and serves as a primer for the combustion of the main charge of propropellant disposed in the supply chamber portion. Ignition of this primer is provided by the sparkplug. Ignition of the primer generates combustion gas whose pressure drives the piston to the right to increase the volume of the combustion chamber portion and to decrease the volume of the pumping chamber portion. The difference in areas of the two faces of the piston generates a difference in pressure in the two chambers so that liquid propellant is continually forced through the bores 116 into the combustion chamber at a controlled rate. The piston head is displaced continually to the right towards the closed check valve 36. As the piston head closes onto the annulus 74 of the check valve the remainder of the liquid propellant trapped therebetween provides an energy absorbing function and absorbs the energy of the moving piston head as it impacts against the check valve annulus, without any ullage. The interface surfaces 110 and 74 should be conical, approaching a cylinder, to provide maximum travel time for trapped fluid to absorb energy and pass through the bores, yet not so cylindrical as to trap liquid and prevent such liquid from reaching and passing through the bores.

The interface between the piston stem 104 and the bore 62 may be without seals, since any leakage from the pumping chamber portion will merely pass back into the supply chamber portion. The L-ring section 106 provides an effective seal between the hot gun gas in the combustion chamber and the relatively cold liquid in the pumping chamber portion, in that there is a difference in pressure on the piston head which provides for the flow of liquid propellant from the pumping chamber to the combustion chamber, which precludes any flow of gun gas from the combustion chamber to the pumping chamber.

To provide lubrication between the piston head 102 and the wall of the bore 30, a plurality of shallow, helical grooves 200 may be provided in the peripheral surface of the piston head, communicating from the left face 112 to the right face, adjacent 110. Liquid propellant will be forced through these apertures at the same time as through the bores 116, and will lubricate this interface. All lubricant passing into the combustion chamber portion will be in a swirl pattern, thus providing a film cooling effect to the chamber bore 30, after which it will be burned, either as primer, or as part of the main charge. A fresh supply of lubricant is provided during each firing cycle, and will clean out any particles which may lodge in the grooves.

Lubrication of the interface between the piston stem and the check valve sleeve is also provided by the liquid propellant.

The leakage propellant will act as a booster as well as a primer. The piston compresses air in front of it, and then creates a two-phase mixture in front of it, which on ignition, acts as a booster charge. A small booster charge results in a much faster initial chamber pressure rise which improves ballistic efficiency.

What is claimed is:

1. A liquid propellant, regenerative action, gun comprising:

a cylinder having a longitudinal bore;

a regenerative piston having a head disposed within and circumferentially sealed to said cylinder bore;

said piston head dividing said cylinder bore into a combustion chamber portion and a propellant pumping chamber portion, having a combustion face defining in part said combustion chamber portion and a supply face defining in part said propellant pumping chamber portion, and having a plurality of bores communicating between said supply face and said combustion face;

igniter means disposed within said combustion chamber portion;

means for admitting a quantity of gas into said combustion chamber portion;

means for supplying liquid propellant under pressure;

supply valve means for coupling and for decoupling said supply means to said propellant pumping chamber portion of said cylinder bore;

said piston, said gas admitting means, said supply valve means and said igniter means having a mode of operation such that:

initially said piston is so disposed within said cylinder bore as to provide said pumping chamber portion with substantially zero volume and said combustion chamber portion with its maximum volume, thereafter said gas admitting means admits a quantity of gas into said combustion chamber portion; and thereafter said supply valve means couples said supply means to said propellant pumping chamber portion to admut a first quantity of propellant under pressure into said pumping chamber portion, which admission causes translation of said piston head to increase the volume of said pumping chamber portion and to decrease the volume of said combustion chamber and also causes the passage of a lesser second quantity of propellant from said pumping chamber through said plurality of bores in said piston head into said combustion chamber, said plurality of bores serving to atomize such passed propellant into droplets, whereby said quantity of gas and said second quantity of atomized propellant are compressed in said combustion chamber portion adjacent said igniter means and serve as a primer to be ignited by said igniter means.

2. A gun according to claim 1 wherein:

the opening and closing of said projectile receiving chamber by said gun bolt serves to admit and trap a quantity of air in said combustion chamber portion, which air is compressed subsequently by said piston head while liquid propellant passes through said bores of said piston head, to provide a two phase mixture of gas and atomized liquid propellant in said combustion chamber portion.

3. A gun according to claim 1 wherein:

said piston head has a peripheral surface which engages the inner wall of said cylinder bore, and a groove is provided in said piston head peripheral surface communicating from said supply face to said combustion face of said piston head, whereby when said valve means couples said supply means to said propellant pumping chamber portion and liquid propellant under pressure enters said propellant pumping chamber portion, a portion of such liquid propellant passes through said groove in said piston head peripheral surface and serves as a lubricant for the interface of said piston head peripheral surface and said cylinder bore inner wall, as well as a film coolant to said cylinder bore inner wall.

4. A gun according to claim 3 wherein:

said groove comprises one of a plurality of helically extending, annularly spaced apart grooves.

5. A process of charging a liquid propellant gun having a differential piston with propellant injection bores therethrough for regenerative injection of propellant into the combustion chamber from a propellant pumping chamber, wherein said piston interfaces both said combustion chmber and said pumping chamber, comprising:

translating said piston to provide said pumping chamber with substantially zero volume and said combustion chamber with its maximum volume;

admitting liquid propellant under pressure into said pumping chamber to translate said piston to increase the available volume of the pumping chamber and to decrease the volume of the combustion chamber and to concurrently force a quantity of propellant from said pumping chamber through said injection bores and atomizing said quantity of propellants into droplets and into said combustion chamber.

6. A process according to claim 5 further including:

admitting a second quantity of gas into said combustion chamber;

compressing said gas and said droplets into a two phase mixture.

* * * * *

UNITED STATES PATENT OFFICE

CERTIFICATE OF CORRECTION

Patent No. 4,050,348 Dated Sept. 27, 1977

Inventor(s) Alfred Rapp Graham

It is certified that error appears in the above-identified patent and that said Letters Patent are hereby corrected as shown below:

Column 3, line 12 change "gas" to --gun--; line 23 change "applied" to --applies--; line 26 change "thesurfaces" to --the surfaces--.
Column 5, line 14 change "admut" to --admit--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*